United States Patent [19]

De Sousa

[11] 4,011,683

[45] Mar. 15, 1977

[54] SECTIONAL TOY BLOCK

[76] Inventor: Emilio José Jordão De Sousa, Rua do Salitre 171-3°, Lisboa, Portugal

[22] Filed: Aug. 21, 1975

[21] Appl. No.: 606,590

[30] Foreign Application Priority Data

Feb. 21, 1975 Portugal ..... 6433

[52] U.S. Cl. ..... 46/25

[51] Int. Cl.[2] ..... A63H 33/08

[58] Field of Search ..... 46/24, 25; 35/34, 35 J, 35/71, 72

[56] References Cited

UNITED STATES PATENTS

| | | | |
|---|---|---|---|
| 747,711 | 12/1903 | Hollingsworth | 35/72 |
| 2,738,594 | 3/1956 | Swingle | 35/34 |
| 3,561,757 | 2/1971 | Schillig | 46/25 |
| 3,905,150 | 9/1975 | Dawn | 46/25 |

FOREIGN PATENTS OR APPLICATIONS

| | | | |
|---|---|---|---|
| 323,328 | 1/1930 | United Kingdom | 35/27 |

*Primary Examiner*—Louis G. Mancene
*Assistant Examiner*—Robert F. Cutting
*Attorney, Agent, or Firm*—Haseltine, Lake & Waters

[57] ABSTRACT

Toy blocks capable of being associated to form an assembly are provided. Each block has first and second juxtaposed portions of generally triangular shape with complementary hypotenuse faces facing in opposite directions. All the other faces of the block are planar. When the hypotenuse faces of one block are interfitted with the hypotenuse faces of a second block, a polyhedron, such as a cube, can be formed. Various other assemblies can be produced and the side faces ornamented as desired.

9 Claims, 6 Drawing Figures

FIG. 1
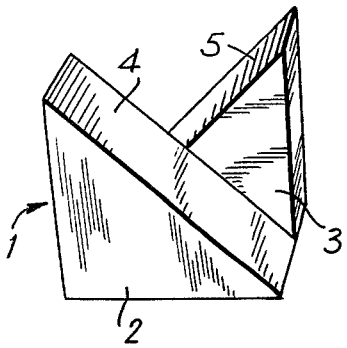
FIG. 2
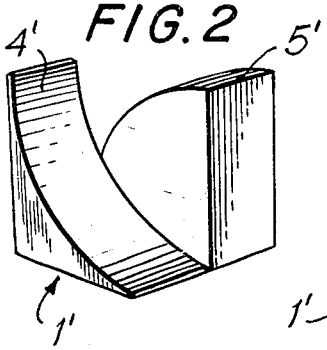
FIG. 3
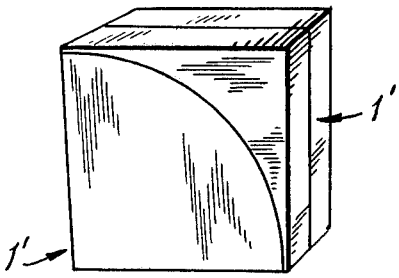
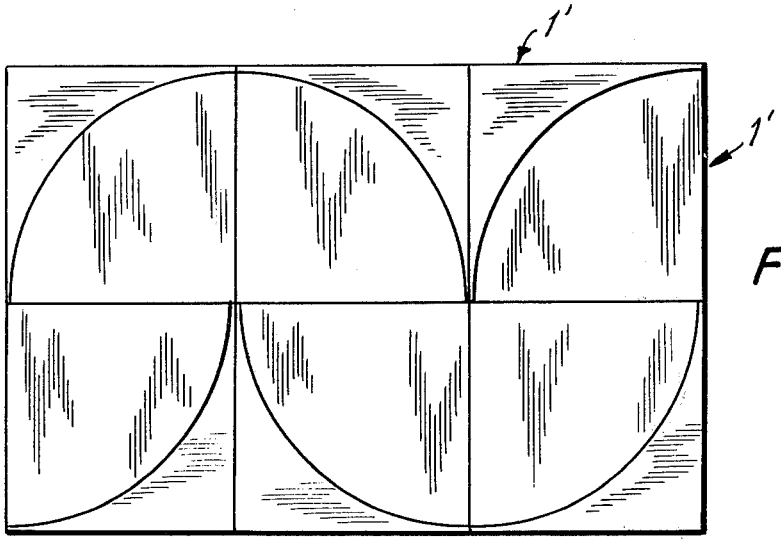
FIG. 4
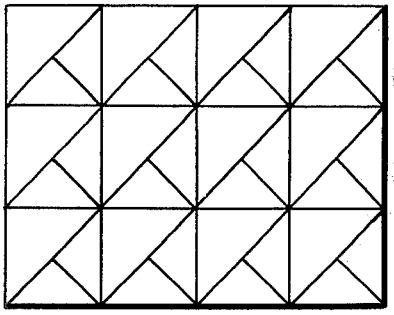
FIG. 5
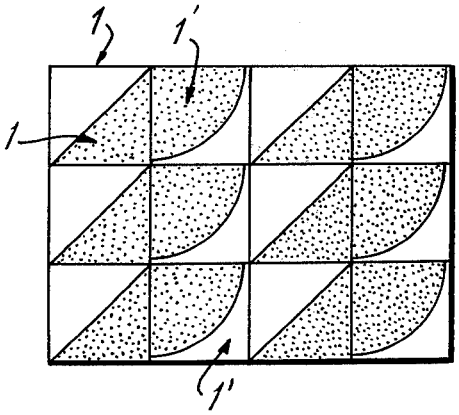
FIG. 6

SECTIONAL TOY BLOCK

FIELD OF THE INVENTION

The invention relates to blocks which, when associated in convenient number, forms a set that constitutes an instructive game of great interest. This set is preferably intended for use by individuals being taught at school.

BACKGROUND

Heretofore, no shape has been known which when associated with others allows a practically unlimited number of compositions that can be used as a pedagogic means. On the other hand, all the existing shapes do not enable stimulation of the creative capacity of each individual, and, in many cases, they are mere associations of compositions that are pre-established by the manufacturer.

SUMMARY OF THE INVENTION

An object of the invention is to provide a block whose shape is such that it can be interfitted with other blocks in a variety of interesting and instructive ways.

According to the invention, the block can be considered as formed of two solid portions whose end faces are right-angled triangles and whose side faces are rectangles, these solid portions being coupled in a juxtaposed manner such that the hypotenuse faces of the triangles cross each other. The two solid portions are associated in a convenient manner such that two blocks can form a rectangular parallelepiped.

In one embodiment of the invention, the hypotenuse faces are planar and in another embodiment, the hypotenuse faces are curved or polygonal.

The two portions of the block can have respective convex and concave complementary portions. The block can also be formed with only one curved face.

Generally speaking, any type of contour or configuration can be arranged for the hypotenuse faces, provided that one of the said faces of one of the solid portions is necessarily complementary to the face of the second solid portion, that is, when the two solid portions that form the block are conveniently associated, it is always possible to form a rectangular parallelepiped.

In this manner, and bearing in mind the preceding condition, when two blocks are interfitted, it is always possible to form a cube which can be considered as representing the simplest assembly.

When a greater number of blocks is available, the most varied assemblies can be formed such as networks, standards or three-dimensional combinations. In these assemblies, arrangements can be made, both with the coloring of the edges and with the placing of the faces of a block next to each other so that an unlimited range of geometrical shapes is thus obtained.

On the other hand, each block is preferably of a single color and a set consists of two differently colored blocks. Decorative appearances can similarly be made by coloring any of the faces to obtain bands, areas or designs and, in a general manner, areas with identical coloring.

The use of color ornamentation greatly enlarges the possibilities of the invention, not only because it allows areas of different colors to be formed, but also because it constitutes an element of attraction essential in games or toys of this type.

When the blocks themselves have more than one color, the number of possibilities of the invention is still further enlarged.

As the fundamental object of the invention is a game that when used in learning institutions or at home, the dimensions will be reduced. If the blocks are used as kindergarten equipment, the dimensions shall be preferably larger. Likewise, if the blocks are used as pieces of furniture, namely as exhibition stands, tables, or as decorative elements according to another object of the invention, they shall have appropriate dimensions.

It remains to be added that the joinder of the solid portions that form the block may be effected by any convenient process, namely, by adhesives or fitting, but preferably each block is obtained directly from a single mold and is of a material that provides it with the necessary rigidity and nondeformability, namely a hard plastic, the mold being closed by a cover which forms the faces of the cube.

This molding process enables a large series of blocks to be obtained at an economical price, a predominant factor for the game being that in order to form appropriate compositions, it is suitable to have a high number of blocks, namely a minimum of eight blocks.

BRIEF DESCRIPTION OF THE DRAWING

FIG. 1 is a perspective view of a block all of whose faces are planar;

FIG. 2 shows a modified block with two curved faces, one concave and the other convex;

FIG. 3 shows an assembly of two blocks of FIG. 2 to form a cube;

FIG. 4 is a side view of another assembly of 12 blocks of FIG. 2;

FIG. 5 shows a three-dimensional assembly; and

FIG. 6 shows an assembly of twelve blocks of FIG. 1 with 12 blocks of FIG. 2.

DETAILED DESCRIPTION

Referring to FIG. 1 of the drawing, therein is seen a first embodiment of a block according to the invention designated generally by numeral 1. The block comprises first and second juxtaposed portions 2 and 3, each of which is of triangular shape and formed with planar faces. The portions 2 and 3 face in opposite directions, such that the hypotenuse faces 4,5 extend along intersecting planes.

The portions 2 and 3 are symmetrical and a second identical block can be interfitted with the first by matching the hypotenuse faces thereof. The resulting body will form a rectangular parallelepiped and preferably the dimensions are such that a cube is formed.

FIG. 2 shows a modification in which the hypotenuse faces 4' and 5' are not planar, as in the embodiment of FIG. 1, but rather are of complementary shape. Namely, hypotenuse face 4' is concave, while hypotenuse face 5' is convex, the arrangement being such that when two identical blocks are interfitted as shown in FIG. 3, the convex face of one will mate perfectly within the concave face of the other and a resulting rectangular parallelepiped body will be obtained as with the embodiment of FIG. 1.

It is essential, therefore, in both embodiments, for the hypotenuse faces of the two portions to be complementary to one another in order to form the rectangular parallelepiped assembly when two identical bodies are interfitted.

The portions 2 and 3 which constitute each block can be secured together in any suitable manner, such as, by adhesive, or by interengageable members (not shown). Preferably, however, each block is obtained as a one-piece body from a mold.

Each block can be constituted from a particular color and the set of blocks may employ blocks of two or more colors. However, each block may have differently colored areas or may be provided with different surface ornamentation.

As a consequence, it becomes possible to construct a substantially unlimited number of forms from the various blocks, both by placing the edges and faces of each block next to those of a further block or by varying the colors of the blocks to obtain bands or other areas of the same color.

FIG. 4 shows an assembly of twelve blocks of the type shown in FIG. 2 in a fanciful arrangement. Quite clearly, a great variety of arrangements can be provided by virtue of the different surface appearance of the side faces of the first and second portions of each block.

FIGS. 5 and 6 show further assemblies of different blocks to give some indication of the variety of assemblies that can be created. Attention is directed particularly to FIG. 6 which shows the combination of blocks of the type in FIGS. 1 and 2.

The blocks of the invention are preferably intended for use by children for development of their creative capacity and thereby such blocks can be an aid in the school advancement of such children.

The blocks are made of a light material which provides the necessary rigidity and non-deformability. Preferably, the blocks are made of a hard plastic material, obtained by a molding process as previously noted.

The blocks can have various unit dimensions, in accordance with their expected use, and, by way of example, they can be used as ordinary size play blocks for children, or they can have relatively large size so as to be capable of being interfitted to form elements of such diverse nature as furniture or as decorative elements. Thus, for example, the blocks of FIGS. 1 and 2 can serve singly as seating surfaces especially when placed on end, and in such configuration, they can also serve as tables.

It is further seen that the blocks are relatively easy to handle, and readily mountable, due to the novel arrangement of the various surfaces.

Although the invention has been described in connection with two specific embodiments, numerous modifications and variations will become evident to those skilled in the art without departing from the spirit and scope of the invention as defined in the attached claims.

What is claimed is:

1. A three-dimensional block capable of being interfitted with a second identical block to form a polyhedron, said block comprising first and second integral juxtaposed portions of generally triangular shape having bases lying in a common plane, side faces lying in parallel planes, end faces superimposed on one another, and hypotenuse faces which are complementary in shape to one another and which are inclined in opposite directions and contained in planes which intersect one another whereby when the hypotenuse faces of a second block are placed on the hypotenuse faces of said one block the polyhedron is formed.

2. A block as claimed in claim 1 wherein said hypotenuse faces are flat.

3. A block as claimed in claim 1 wherein said hypotenuse faces are curved.

4. A block as claimed in claim 3 wherein the hypotenuse face of one portion is concave and the other is complementarily convex.

5. A block as claimed in claim 1 wherein the faces of said first and second portions, apart from the hypotenuse faces, are flat.

6. A block as claimed in claim 5 wherein two of said blocks interfitted along said hypotenuse faces form a rectangular parallelepiped.

7. A block as claimed in claim 6 wherein the dimension of the side faces is related to the dimension of the end faces such that the rectangular parallelepiped is a cube.

8. A block as claimed in claim 1 wherein said first and second portions have end faces which are of respectively different surface appearance.

9. A block as claimed in claim 8 wherein said different surface appearance is obtained by different colorations.

* * * * *